United States Patent [19]

Green et al.

[11] Patent Number: 4,730,424

[45] Date of Patent: Mar. 15, 1988

[54] ROOFTOP WALKWAY

[76] Inventors: William J. Green, 65 W. North Ave., Lake Forest, Ill. 60045; Ralph P. Semmerling, 520 Circle Hill Dr., Arlington Heights, Ill. 60004

[21] Appl. No.: 930,474

[22] Filed: Nov. 14, 1986

[51] Int. Cl.[4] ..... E04C 2/42

[52] U.S. Cl. ..... 52/180; 52/483; 52/507; 52/581

[58] Field of Search ..... 52/177, 180, 671, 507, 52/483, 581; 411/400, 401

[56] References Cited

U.S. PATENT DOCUMENTS

| | | | |
|---|---|---|---|
| 1,105,791 | 8/1914 | Irving | 52/507 |
| 1,105,873 | 8/1914 | Berson | 52/507 |
| 2,322,965 | 6/1943 | McNeil | 52/671 |
| 3,309,119 | 3/1967 | Phillips | 52/507 |
| 3,466,829 | 9/1969 | Robicheaux | 52/180 |
| 4,490,065 | 12/1984 | Ullrich et al. | 411/400 |

FOREIGN PATENT DOCUMENTS

| | | | |
|---|---|---|---|
| 570464 | 7/1945 | United Kingdom | 52/177 |
| 704790 | 3/1954 | United Kingdom | 52/177 |

*Primary Examiner*—James L. Ridgill, Jr.
*Attorney, Agent, or Firm*—Robert M. Didrick; Robert H. Robinson

[57] ABSTRACT

A walkway on a rooftop comprises expanded metal planks supported by U-shaped support stands disposed transversely with respect to the length of the planks. The planks have alternating rows of ridges and valleys, both of which have transverse slits. The planks are connected to the support stands by T-shaped bolts whose crossbars are rounded. The shanks of the T-bolts pass through the slits in the valleys and the crossbars nestle within the valleys in rotatably slidable engagement with the metal.

5 Claims, 4 Drawing Figures

ROOFTOP WALKWAY

This invention relates to the use of expanded metal gratings as elevated walkways on roofs and other structures which need to be protected from the pounding of foot traffic.

Construction standards and materials of the present day as well as modern structural design practices are producing buildings that tend to move and shift more than those of the past. Some types of roofs, particularly the single ply membrane type, are designed to be flexible so that the roof moves with the remainder of the building. Also, the metal grating in a walkway expands and contracts in response to changes in the ambient temperature.

It is an object of this invention, therefor, to provide a walkway which accommodates such movements.

It is a related object of this invention to provide a connector which is rotatably slidable between the expanded metal elements of the walkway grating.

It will be seen from the drawings attached hereto and the description thereof which follows that said objects and others which will become apparent are indeed achieved by this invention.

Turning now to the drawings.

Figure 1:
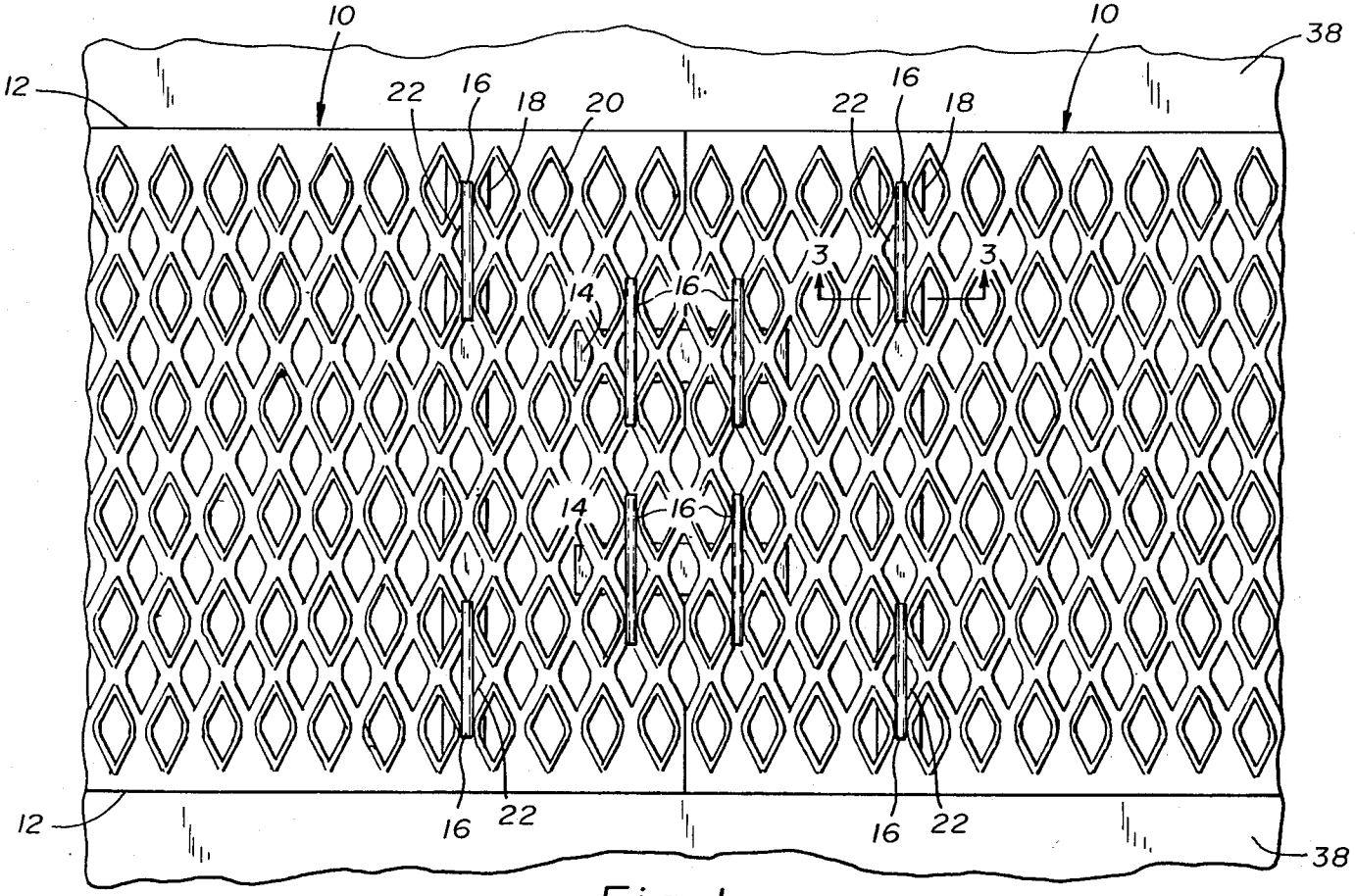
FIG. 1 is a plan view of the rooftop walkway of this invention.
Figure 2:
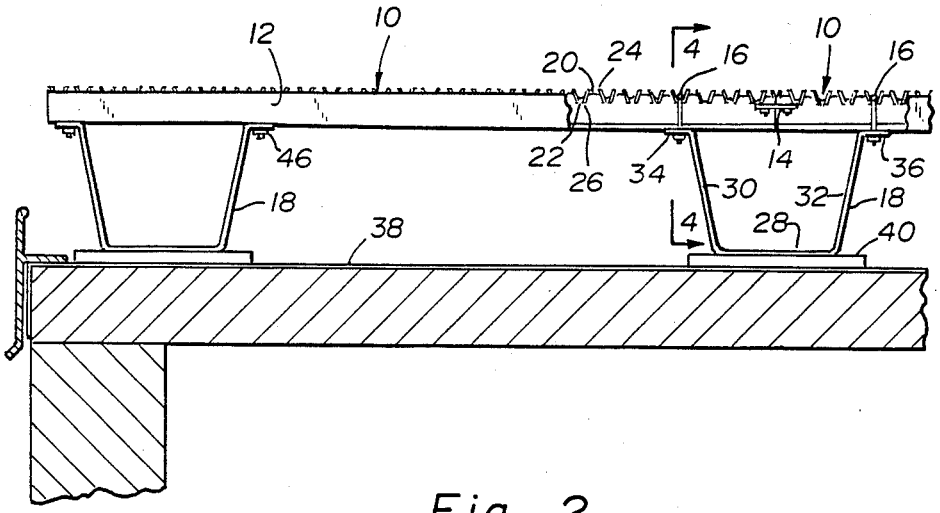
FIG. 2 is a side elevation of a portion of a roof (in cross-section) and the walkway, partially broken away, of this invention resting thereon.

In FIG. 1, the expanded metal planks 10 are reticulated sheets of metal having the smooth surfaced, parallel longitudinal channels 12 at opposite edges of the sheets. The planks 10 are spliced together longitudinally by the splice plate 14 and the T-bolt connectors 16. Each plank 10 is connected by additional T-bolt connectors 16 to the transversely disposed support stand 18, shown more clearly in FIG. 2. The generally diamond shaped slits 20 and 22 are shown in FIG. 2 to be formed in the ridges 24 and the valleys 26, respectively, which are arrayed in alternate rows. The U-shaped stand 18 comprises the base 28, outwardly diverging legs 30 and 32 and the oppositely extending flanges 34 and 36. The stand 18, being as wide as the planks 10 and having the broad base 26, distributes loads over a large area to protect the roof 38. The rubber pad 40 also protects the roof.

Figure 3:
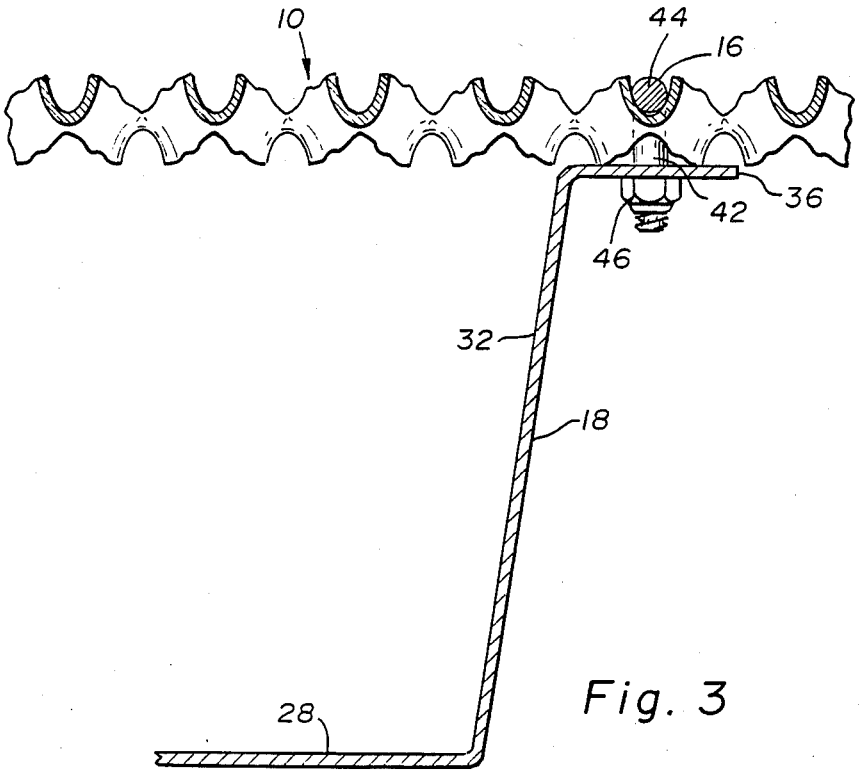
FIG. 3 is a sectional view of the walkway of FIG. 1, taken along the line 3—3 thereof.
Figure 4:
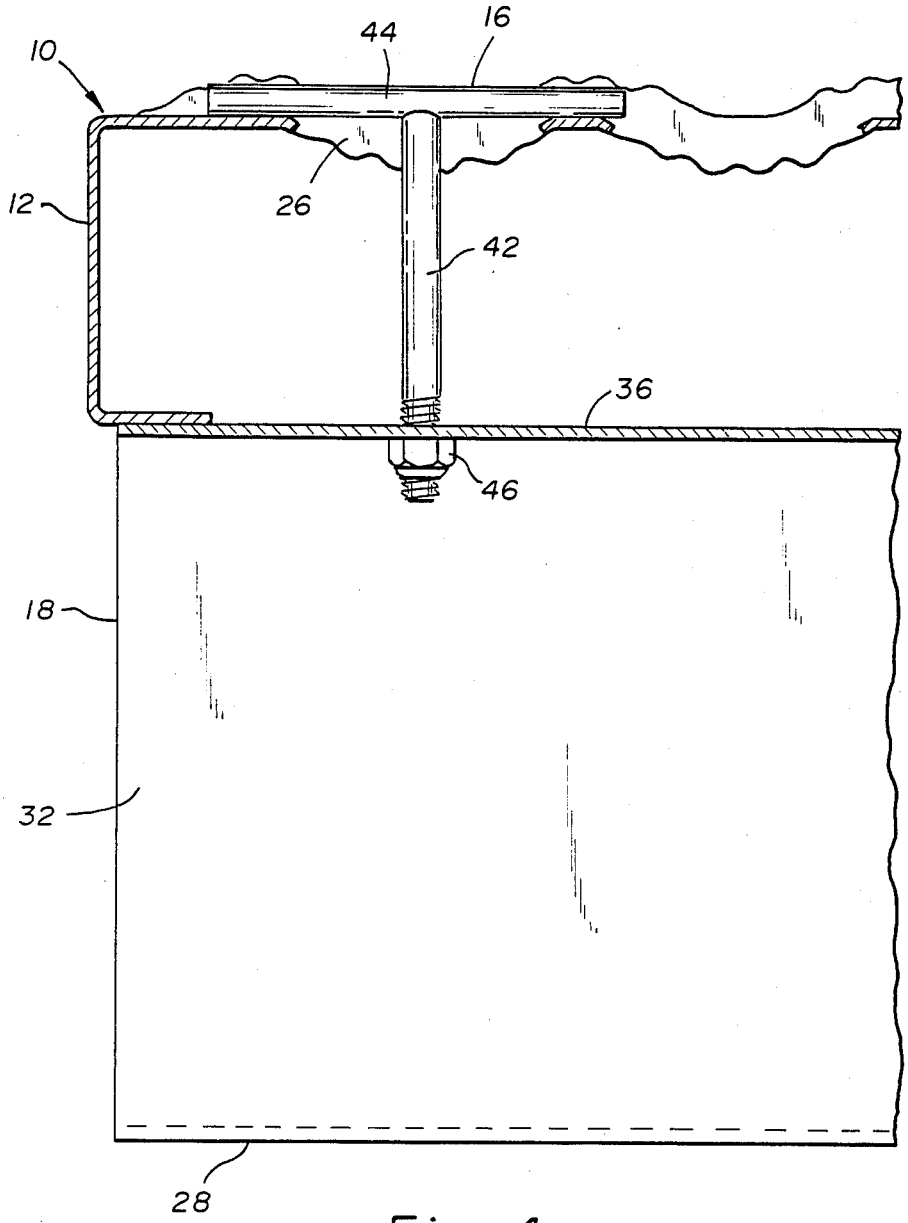
FIG. 4 is a sectional view of the walkway of FIG. 2 taken along line 4—4 thereof.

As seen in FIGS. 3 and 4, the shank 42 of a T-bolt connector 16 is passed through a slit 22 in the plank 10 and into a hole in the flange 36 of the stand 18 and the crossbar 44 drops into a valley 26. The self-locking nut 46 is drawn up to just a snug fit, i.e., the torque required is from about 15 to about 20 inch-pounds, against the flange 36 so that the round crossbar 44 of the T-bolt is in rotatably slidable engagement with the metal beyond the slit 22. Thus, though shifting of the building may cause slight movements of the roof 38 which are transmitted to support stands 18 and cause a slight rocking motion in the stands with respect to the longitude of the plank 10, the rounded surface of the crossbar 44 allows it to roll against the plank like a wrist pin.

The shank 42 of the T-bolt connector 16 may be of various lengths, depending on whether it is used as in FIGS. 1 and 3 or as in FIG. 4 where it must pass through the flange 36 below the channel 12. Lengths of 1.5, 2.5, and 3.75 inches are useful. The diameter of the crossbar 44 may be about 0.375 inch or larger and the length of said crossbar is greater than that of the slit 22. A crossbar 44 about 3 inches long is favored.

While a particular embodiment of this invention has been described, it will be understood that that embodiment may be modified within the spirit and scope of the appended claims. One such modification might be the use of a half-round crossbar in place of the crossbar 44.

The subject matter claimed is:

1. A walkway comprising a reticulated plank; a generally U-shaped support stand to which the plank is fastened transversely, said stand having a horizontal flange underlying the plank; and a plurality of T-shaped bolts connecting the plank and the flange, the crossbars of the bolts having a rounded surface in slidable engagement with the plank.

2. The walkway of claim 1 wherein the plank is made of expanded metal having a multiplicity of lateral slits therein and the T-shaped bolt has a threaded shank which passes through a slit and a crossbar which spans the slit.

3. The walkway of claim 2 wherein the plank has alternating rows of ridges and valleys, the slits are located in the ridges and valleys, the shank of the T-shaped bolt passes through a slit in a valley, and the crossbar is in rotatably slidable engagement with the metal in the valley.

4. The walkway of claim 3 wherein the crossbar lies below the horizontal plane defined by the ridges.

5. A walkway comprising an expanded metal plank having alternating rows of ridges and valleys, said ridges and valleys having lateral slits therein; a generally U-shaped support stand to which the plank is fastened transversely, said stand having a horizontal flange underlying the plank; and a plurality of T-shaped bolts which fasten the plank to the flange, said bolts having threaded shanks which pass through slits in the valleys and crossbars which span the slits, each of the crossbars having a rounded surface which is rotatably slidable engagement with the metal in a valley when the plank and the stand are fastened together.

* * * * *